US012768059B2

(12) United States Patent
Molenberghs et al.

(10) Patent No.: US 12,768,059 B2
(45) Date of Patent: Oct. 20, 2026

(54) HYBRID CERAMIC MEMBRANE FOR WATER ELECTROLYSIS APPLICATION

(71) Applicant: VITO NV, Mol (BE)

(72) Inventors: Bart Molenberghs, Mol (BE); Deepak Pant, Mol (BE); Jan Vaes, Mol (BE); Fady Nahra, Mol (BE); Misgina Tilahun Tsehaye, Mol (BE); Wim De Schepper, Mol (BE)

(73) Assignee: VITO NV, Mol (BE)

( * ) Notice: Subject to any disclaimer, the term of this patent is extended or adjusted under 35 U.S.C. 154(b) by 98 days.

(21) Appl. No.: 18/873,960

(22) PCT Filed: Jun. 19, 2023

(86) PCT No.: PCT/EP2023/066416
§ 371 (c)(1),
(2) Date: Dec. 11, 2024

(87) PCT Pub. No.: WO2023/247420
PCT Pub. Date: Dec. 28, 2023

(65) Prior Publication Data

US 2025/0376777 A1 Dec. 11, 2025

(30) Foreign Application Priority Data

Jun. 22, 2022 (EP) ..... 22180414

(51) Int. Cl.
*C25B 13/07* (2021.01)
*C25B 1/04* (2021.01)
*C25B 1/30* (2006.01)

(52) U.S. Cl.
CPC ..... *C25B 13/07* (2021.01); *C25B 1/04* (2013.01); *C25B 1/30* (2013.01)

(58) Field of Classification Search
CPC .. C25B 1/04; C25B 1/30; C25B 13/02; C25B 13/07; C25B 13/08; Y02E 60/50
See application file for complete search history.

(56) References Cited

U.S. PATENT DOCUMENTS

2005/0252446 A1* 11/2005 Hoshino ..... C04B 41/87 118/500
2019/0389778 A1 12/2019 Campbell et al.
2020/0102663 A1 4/2020 Xu et al.

FOREIGN PATENT DOCUMENTS

| | | | |
|---|---|---|---|
| EP | 0900249 | B1 | 10/2003 |
| EP | 2017240 | A1 | 1/2009 |
| JP | 7126410 | A | 5/1995 |
| JP | 2020098780 | A | 6/2020 |
| KR | 20150100301 | A * | 9/2015 |
| KR | 101971269 | B1 | 4/2019 |
| KR | 20220081811 | A | 6/2022 |
| WO | 2006036957 | A2 | 4/2006 |
| WO | 2006036957 | A3 | 4/2006 |

OTHER PUBLICATIONS

Translation of KR 20150100301, Sep. 2, 2015. (Year: 2015).*
International Search Report and Written Opinion issued in PCT/EP2023/066416, pp. 1-13, Apr. 17, 2024.

* cited by examiner

*Primary Examiner* — Hai Vo
(74) *Attorney, Agent, or Firm* — DINSMORE & SHOHL LLP

(57) ABSTRACT

The present invention relates to a method of manufacturing a dense composite polymeric-ceramic membrane, compromising the steps of casting a porous ceramic support layer comprising YSZ and $TiO_2$ flakes, followed by thermal curing and sintering steps, coating the prepared porous ceramic support structure with a thin layer of $TiO_2$ to vary the pore size distribution of the support structure and further densification by using ion selective polymers to reduce gas crossover while maintaining a high enough conductivity.

21 Claims, 6 Drawing Sheets

HYBRID CERAMIC MEMBRANE FOR WATER ELECTROLYSIS APPLICATION

CROSS-REFERENCE TO RELATED APPLICATIONS

This application is a National Stage Application under 35 U.S.C. § 371 of International Application Serial No. PCT/EP2023/066416, filed Jun. 19, 2023, which International Application claims benefit of priority to European Patent Application No. 22180414.9, filed Jun. 22, 2022, each of which is incorporated herein by reference in its entirety.

TECHNICAL FIELD

The present invention is related to a dense composite polymeric-ceramic membrane and to a method of manufacturing said membrane. In particular, the membrane comprises a porous ceramic support layer, coated with a nanoparticle layer and pore-filled with ion conductive polymer for application in alkaline water electrolysis application.

BACKGROUND ART

It is known that ceramic membranes are applied in various applications, such as liquid filtration, gas separation and energy devices due to their good mechanical strength and stability against chemicals attack. They can withstand harsh conditions, such as high pH, low pH, high temperatures and high pressure, among others. Porous polymeric membranes, on the other hand, cannot withstand such harsh conditions despite their ease of processing and preparation.

Hydrogen is used in almost every industry, including stationary and transportation markets as an energy carrier, petroleum refining, and fertilizer production. Currently, it is primarily derived from fossil fuels, mainly natural gas and heavy oils and naphtha, via steam hydrocarbon (e.g., methane) reforming, in which, a hydrocarbon (e.g., methane) reacts with steam in the presence of a catalyst to produce hydrogen and carbon dioxide ($CO_2$). This raises environmental concerns as the $CO_2$ emitted is a major contributor to global climate change.

Another approach to produce hydrogen gas is from water using renewable energy sources, which has become of particular interest and is considered to be the most promising technique because it emits only water and oxygen as byproducts, without $CO_2$ emissions. The hydrogen produced in this way is called green hydrogen since water is just splitting into oxygen and hydrogen under the influence of electricity.

In alkaline water electrolysis, in which aqueous KOH or NaOH is used as electrolyte, water is first reduced to hydroxide ion (OH) and hydrogen gas ($2H_2O+2e^- \rightarrow H_2+2OH^-$) at the cathode electrode. The produced $OH^-$ ion is then transported to the anode electrode through the membrane and discharged to $O_2$ and water $$\left(2OH^- \rightarrow H_2O + \frac{1}{2}O_2 + 2e^-\right).$$

The two electrodes are separated by a membrane. The main function of the membrane is to provide $OH^-$ion conduction and avoid product gases crossover. It also prevents electrolyte mixing and short-circuiting. For said reasons the separation membrane should be dense, but with a low resistance to the ionic transport across the membrane.

Today, commercially available Zirfon™ Perl UTP 500 (Agfa-Gevaert N.V.), a 500 μm thick porous composite material made up of zirconium dioxide ($ZrO_2$) and polysulfone, is the most commonly used membrane in alkaline water electrolysis (10.1149/1945-7111/abda57).

When such porous membranes are employed, $H_2$ gas could diffusive into the $O_2$ stream and cause explosion when the $H_2$ concentration reaches the lower explosion limit (4%). Additionally, according to the manufacturer's datasheet, Zirfon™ Perl UTP 500 maximum operating temperature is only 110° C.

Therefore, a scalable method to prepare self-standing mechanically robust hybrid ceramic membrane with controlled pore size remains elusive.

On the other hand, despite the recent progress on the development of anion exchange membranes (AEMs), a durable and optimized AEM for an alkaline water electrolysis cell is yet to be developed (https://doi.org/10.1115/1.4047963).

It is known that porous ceramic membranes comprise a thick layer of porous support, which provides mechanical strength and one or more thin selective inorganic (and/or polymeric) layer. It is usually prepared using, or combinations of, metal oxides, mainly $Al_2O_3$, $TiO_2$, $SiO_2$ or $ZrO_2$ powders, among others.

Campbell (US 2019/0389778 A1) discloses a method for preparing 3D porous ceramic materials for carbon dioxide capture system. The pores are reported to connect through the ceramic structure from one side of the ceramic structure to the opposite side of the material.

These membranes exhibit excellent mechanical and chemical stability properties.

However, it is necessary to further densify (narrow their pore size) the membranes for use in alkaline water electrolysis. One way to do that is to fill/densify the pores of the ceramic membrane by coating the membrane with a nanoparticle layer.

Growing polymer brushes on ceramic materials is another interesting approach that has been recently utilized to functionalize and densify porous ceramic membranes for nanofiltration membrane processes (PCT patent publication WO2020016068).

Thus, it would be desirable to develop a durable hybrid ceramic membrane with high chemical and thermal stabilities and no/low ($H_2$) gas crossover for an alkaline water electrolysis and/or related systems by first fabricating a porous ceramic membrane and further densification via nanoparticle and ion-conducting polymer materials.

SUMMARY OF INVENTION

According to a first aspect of the invention, there is therefore provided a method of preparing a dense hybrid ceramic membrane, hereinafter also referred to as a dense composite polymeric-ceramic material, as set out in the appended claims.

Said method of manufacturing such dense composite polymeric-ceramic material as defined in the appended set of claims, comprises:

- combining $TiO_2$ nanoparticles, at least another metal oxide nanoparticle and a curable polymer resin to create a mixture;
- curing the mixture to obtain a first composite material;
- heating the first composite material to a first temperature for removing the polymer from said first composite material to obtain a second composite material;

heating the second composite material to a second temperature for sintering the $TiO_2$ nanoparticles, and the at least another metal oxide nanoparticles, thereby creating the ceramic porous support layer;

coating said ceramic porous support layer with a $TiO_2$ suspension to obtain a $TiO_2$-coated ceramic porous support layer; and polymer filling pores of the $TiO_2$-coated ceramic porous support layer to obtain the dense composite polymeric-ceramic material as defined in any one of the appended set of claims.

In an embodiment according to the method of the invention, the at least another metal oxide nanoparticle is selected from alumina ($Al_2O_3$), yttria fully stabilized zirconia ($Y_2O_3$-doped $ZrO_2$ (YSZ), yttria (tetragonal zirconia polycrystal ($Y_2O_3$-doped $ZrO_2$ (Y-TZP)), $CeO_2$, $CeO_2$ tetragonal $ZrO_2$ polycrystal (Ce-TZP), $ZrO_2$, $SiO_2$, $SnO_2$, and the like; in particular the at least another metal oxide nanoparticle metal oxide nanoparticles is yttrium-doped zirconium oxide (YSZ).

In an embodiment of the method according to the invention, the mixture of $TiO_2$ nanoparticles, at least another metal oxide nanoparticle and a curable polymer resin, comprises $TiO_2$ nanoparticles in a range of about 1 wt % to about 20 wt % of the total mixture; in particular in a range of about 5 wt % to about 15 wt % of the total mixture.

In an embodiment of the method according to the invention, the mixture of $TiO_2$ nanoparticles, at least another metal oxide nanoparticle and a curable polymer resin, comprises at least another metal oxide nanoparticle in a range of about 50 wt % to about 80 wt % of the total mixture; in particular in a range of about 60 wt % to about 70 wt % of the total mixture.

In an embodiment of the method according to the invention, the $TiO_2$ suspension comprises $TiO_2$ in a range of about 1 wt % to about 5 wt %.

In an embodiment of the method according to the invention, the ceramic porous support layer is coated with $TiO_2$ via dip-coating.

In the method of manufacturing the dense composite polymeric-ceramic material as defined in the appended set of claims, the $TiO_2$-coated ceramic porous support layer is further functionalized with polymer filling the pores of the $TiO_2$-coated ceramic porous support layer.

As mentioned herein before, in the method of the invention, the polymer filling of the pores can be via polymer impregnation or an in situ polymerization of the pore walls. The in situ polymerization could for example consist of a surface-initiated atom-transfer radical polymerization (SI-ATRP) reaction; in particular using a monomer such as (but not limited to) acrylate and styrene derivatives. Polymer impregnation van be done using any suitable polymer, such as polysulfone (PSU) and poly (p-phenylene oxide) (PPO), an anion-binding polymer, an ionomer or combinations thereof In said embodiments wherein the polymer impregnation is done using an ionomer, said ionomer is in particular selected from a halogen ionomer, such as a fluorinated ionomer containing sulfonate groups based on ionized sulfonic acid (e.g., fluorosulfonic acid (i.e., FSA) ionomer), or a hydrocarbon ionomer preferably containing (meth)acrylate groups based on ionized (meth)acrylic acid; or combinations thereof.

In a particular embodiment the present invention provides a method for manufacturing of bipolar membranes, using either the ceramic porous support layer or the $TiO_2$-coated porous ceramic support layer herein provided, but characterized in that:

the pores from one side of either ceramic porous layers are filled with a first ionomer via diffusion of a solution of said ionomer from that side followed by precipitation of said ionomer, and.

the pores from the other side of either ceramic porous layers are filled with a second ionomer via diffusion of a solution of said ionomer from that second side followed by precipitation of said ionomer.

In another embodiment the present invention provides a method for manufacturing of bipolar membranes, using the $TiO_2$-coated ceramic porous support layer herein provided, but characterized in that:

the pores from one side of the $TiO_2$-coated ceramic porous support layer are filled with a first ionomer via diffusion of a solution of said ionomer from that side followed by precipitation of said ionomer, and.

the pores from the other side of the $TiO_2$-coated ceramic porous support layer are filled with a second ionomer via diffusion of a solution of said ionomer from that second side followed by precipitation of said ionomer.

According to a second aspect the present invention provides a dense composite polymeric-ceramic material comprising:

a. a ceramic porous support layer composed of $TiO_2$ nanoparticles, and at least another metal oxide nanoparticle, b. a porous coating layer of $TiO_2$ nanoparticles coated onto said ceramic porous support layer, and c. a polymer filling at least the pores of the ceramic porous material.

In an embodiment of the dense composite polymeric-ceramic material according to the invention, a polymer filling is present both in the pores of the ceramic porous support layer and in the pores of the porous coating layer of $TiO_2$ nanoparticles.

In an embodiment of the dense composite polymeric-ceramic material according to the invention, the at least another metal oxide nanoparticle is selected from alumina ($Al_2O_3$), yttria fully stabilized zirconia ($Y_2O_3$-doped $ZrO_2$ (YSZ)), yttria (tetragonal zirconia polycrystal ($Y_2O_3$-doped $ZrO_2$ (Y-TZP)), $CeO_2$, $CeO_2$ tetragonal $ZrO_2$ polycrystal (Ce-TZP), $ZrO_2$, $SiO_2$, $SnO_2$, and the like; in particular the at least another metal oxide nanoparticle metal oxide nanoparticles is yttrium-doped zirconium oxide (YSZ).

As evident from the manufacturing methods mentioned hereinbefore, in the preparation of the materials use is made of a mixture of polymer resin comprising the $TiO_2$ nanoparticles, and the at least another metal oxide nanoparticle. It is accordingly not surprising, that after curing and sintering some of the polymeric resin could reside in the obtained porous ceramic support layer. Thus in an embodiment of the dense composite polymeric-ceramic material according to the invention it further comprises a polymer resin; in particular a cross-linkable polymer.

In an embodiment of the dense composite polymeric-ceramic material according to the invention, the polymer resin is selected from an acrylate that can be cross-linked using a thermal initiator (e.g. a cross-linking agent) or an acrylate that may be cross-linked using an ultraviolet (UV) light-activated initiator, for example but not limited to, polyethylene glycol diacrylate (PEGDA) plus a thermal initiator (e.g., 3 wt % Luperox 331).

In an embodiment of the dense composite polymeric-ceramic material according to the invention the porous ceramic support layer comprises $TiO_2$ nanoparticles in a range of about 1 wt % to about 20 wt % of the total porous ceramic support layer; in particular in a range of about 5 wt % to about 15 wt % of the total porous ceramic support layer.

In an embodiment of the dense composite polymeric-ceramic material according to the invention the ceramic porous support layer, herein also referred to as the porous ceramic support material, comprises the at least another metal oxide nanoparticles in a range of about 50 wt % to about 80 wt % of the total porous ceramic support material; in particular in a range of about 60 wt % to about 70 wt % of the total porous ceramic support material.

In an embodiment of the dense composite polymeric-ceramic material according to the invention the ceramic porous support layer has an average pore size in the range of about 80 to 200 nm.

In an embodiment of the dense composite polymeric-ceramic material according to the invention said ceramic porous support layer is a membrane with a thickness between about 50 and 2000 μm; in particular between 50 and 1000 μm; more in particular between 50 and 200 μm.

In an embodiment of the dense composite polymeric-ceramic material according to the invention the coating layer of $TiO_2$ nanoparticles has an average thickness between 0.5 and 5 μm and average pore size distribution between 50 and 150 nm.

In an embodiment of the dense composite polymeric-ceramic material according to the invention the polymer filling the pores of at least the ceramic porous support layer is done via polymer impregnation wherein the polymer is selected from any suitable polymer, such as polysulfone (PSU) and poly (p-phenylene oxide) (PPO), an anion-binding polymer, an ionomer or combinations thereof In an embodiment of the dense composite polymeric-ceramic material according to the invention the polymer filling the pores of at least the ceramic porous support layer is done using an ionomer selected from a halogen ionomer, such as a fluorinated ionomer containing sulfonate groups based on ionized sulfonic acid (e.g., fluorosulfonic acid (i.e., FSA) ionomer), or a hydrocarbon ionomer preferably containing (meth)acrylate groups based on ionized (meth) acrylic acid; or combinations thereof.

In an embodiment of the dense composite polymeric-ceramic material according to the invention the polymer filling the pores of at least the ceramic porous support layer is done using in situ polymerization of the pore walls; in particular using a surface-initiated, atom-transfer radical polymerization (SI-ATRP) reaction; more in particular using SI-ATRP with a monomer such as (but not limited to) acrylate and styrene derivatives.

In a third aspect the present invention provides the use of the dense composite polymeric-ceramic material as herein defined, or obtained according to the methods of the present invention, in filtration or electrochemical applications, such as a fuel-cell, hydrogen peroxide production and alkaline water electrolysis.

In a particular embodiment the porous ceramic support layer is made of 3% mol. Yttria Stabilized Zirconia (referred to here as YSZ) and $TiO_2$ nanoparticles. Advantageously, the $TiO_2$ nanoparticle increases the mechanical stability of the membranes. Moreover, the dimensional shrinkage and bending after the sintering has been improved.

In following steps, to this exemplary porous ceramic support material a thin layer coating of $TiO_2$ particles is deposited on top in order to vary the pore size and pore size distribution of the membrane. Advantageously, this fills the surface large pores, narrows the pore size distribution, and increases the prepared membrane's mechanical strength.

At last, the examples hereinafter, provide three possible modes for the further densification of the pores of a thus obtained $TiO_2$ coated porous ceramic support material using a polymer such as for example an anion exchange polymer, as pore filler; either (i) the porous ceramic support material is functionalized in order to accommodate polymerization starting from the pore walls, (ii) a monomer solution of the targeted ion exchange polymer is diffused through the pores and then polymerization is initiated until the pores are completely filled, or iii) a polymer and/or ionomer solution is diffused through the pores followed by polymer/ionomer precipitation via phase inversion or solvent evaporation In all cases, the ceramic material can be additionally (pre- or post-) functionalized to further accommodate $OH^-$ ion-conducting groups. Upon polymerization of the pores, the material will behave as a dense hybrid membrane (Meynen V. et al., Current Organic Chemistry, 18:18, 2014, 2334-2350) significantly reducing gas crossover, whilst keeping its ionic conductive property due to the properties of the AEM polymer/functionalized ceramic used (Christopher G. Arges and Le Zhang, ACS Appl. Energy Mater., 2018, 1, 7, 2991-3012).

Membranes with different degree of densification (and/or different pore size) can be obtained with method of the present invention.

BRIEF DESCRIPTION OF THE FIGURES

Various aspects of the invention will now be discussed in greater detail with reference to the appended drawings, with the same reference numerical illustrating the same attributes.

DESCRIPTION OF EMBODIMENTS

Figure 1:
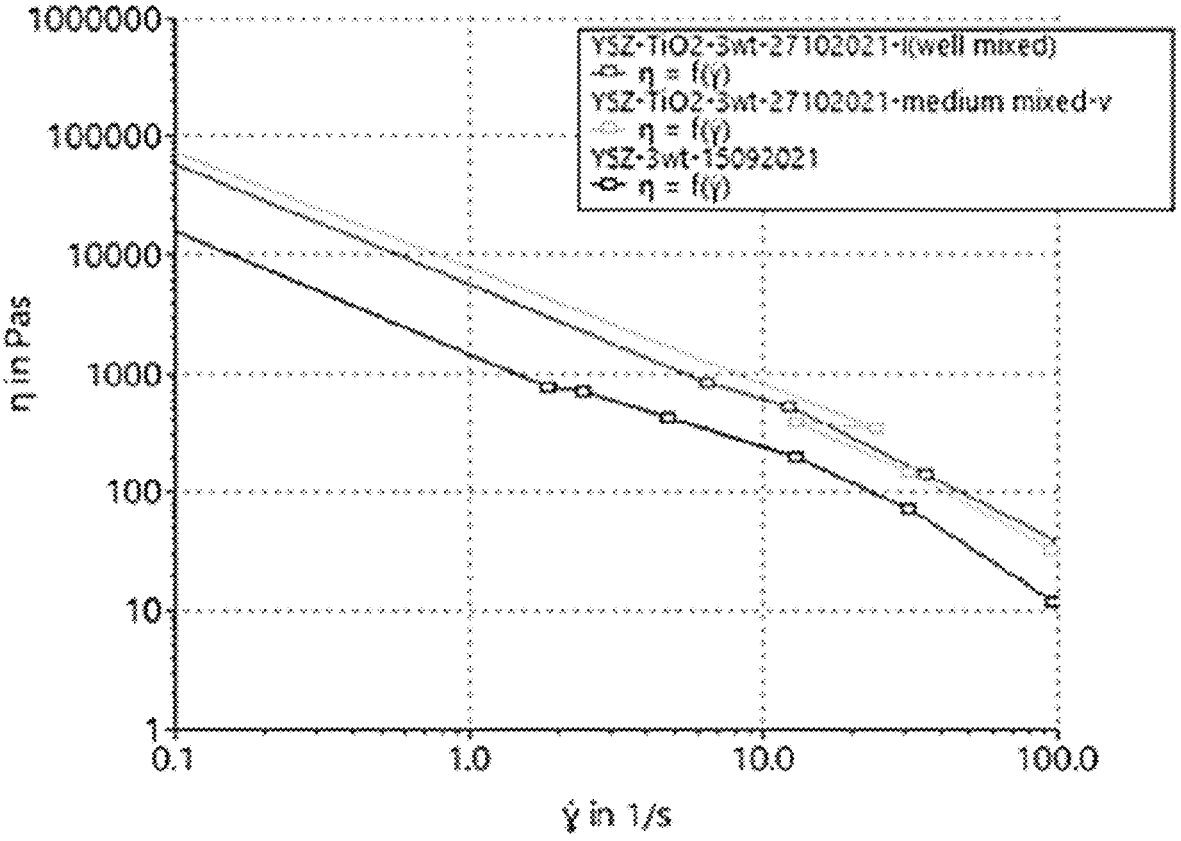
FIG. 1 Viscosity of YSZ-$TiO_2$ slurry at 25° C.

A list of abbreviations used in the description is provide below.

AEM Anion exchange membrane
$CO_2$ Carbon dioxide
° C. degrees Celsius
DI Deionized water
DMF N, Ndimethylformamide
g gram
He Helium
Hg Mercury
H hour
$H_2$ Hydrogen
$H_2O$ water
KOH Potassium hydroxide L331 Luperox® 331M80, 1,1-Bis(tert-butylperoxy)cyclohexane solution
mg milligram
mL milliliter
min minute
nm nanometer
NMP N-Methyl-2-pyrrolidone
$OH^-$ Hydroxide ion
$O_2$ Oxygen
PEGDA Polyethylene glycol-diacrylate
PVA Polyvinyl alcohol
rpm Revolutions per minute
RO Reverse osmosis
RT Room temperature
SEM Scanning electron microscope
SI-ATRP Surface-initiated atom-transfer radical polymerization
S second
$TiO_2$ Titanium oxide
TGA Thermogravimetric analysis
μm micrometer
Wt. % Weight percent
YSZ 3% mol. Yttria stabilized zirconia
YSZ-$TiO_2$ Membrane made up of YSZ and $TiO_2$
YSZ-$TiO_2$-T YSZ-$TiO_2$ membranes coated with $TiO_2$ nanoparticles
YSZ-$TiO_2$-T-ionomer YSZ-$TiO_2$-T membranes modified with an ionomer
$ZrO_2$ Zirconium oxide As mentioned hereinbefore, it is an object of the present invention to provide a material, in particular a dense composite polymeric-ceramic membrane that compromises a porous ceramic support, coated with a $TiO_2$ nanoparticle layer and which is pore-filled with ion conductive polymer for application in alkaline water electrolysis application. Using the combination of such a coating with $TiO_2$ nanoparticles, and a polymer filing of the pores, it has been found that for application in water electrolysis applications, gas cross-over can be prevented, and this without affecting anion conductivity.

A 'dense' composite polymeric-ceramic membrane as used herein is meant to refer to a 'dense' membrane of a polymeric-ceramic material, wherein such 'dense' membrane consists of a structure with no detectable pores at the limits of electron microscopy (typically having a lower limit of about 0.1 nm, it includes pores with an average pore size of up to 0.1 nm) but which still enables transport of molecules across the membrane by diffusion under the driving force of a pressure, concentration, or electrical potential gradient.

To said extend it has been found that in the manufacture of the porous ceramic support layer it is beneficial combining $TiO_2$ nanoparticles with at least another metal oxide nanoparticle, preferably yttrium-doped zirconium oxide (YSZ), and a curable polymer resin, preferable a curable cross-linkable polymer such as Poly(ethylene glycol) diacrylate (PEGDA). In the absence of $TiO_2$, casting of the material is possible but the thus obtained porous ceramic support layer is visibly warped/deformed (not flat). Adding $TiO_2$ nanoparticles (in particular at least 10 wt %) solves this problem.

Thus, in a first step of the manufacture of the materials according to the invention, such mixture of $TiO_2$ nanoparticles with at least another metal oxide nanoparticle and a curable polymer resin, is shaped for example by (but not limited to) mold casting, spin casting or knife casting, and then cured trough initiation of the curable polymer resin, yielding a so named green body of the final product (See examples 1 and 2 below).

Figure 5:
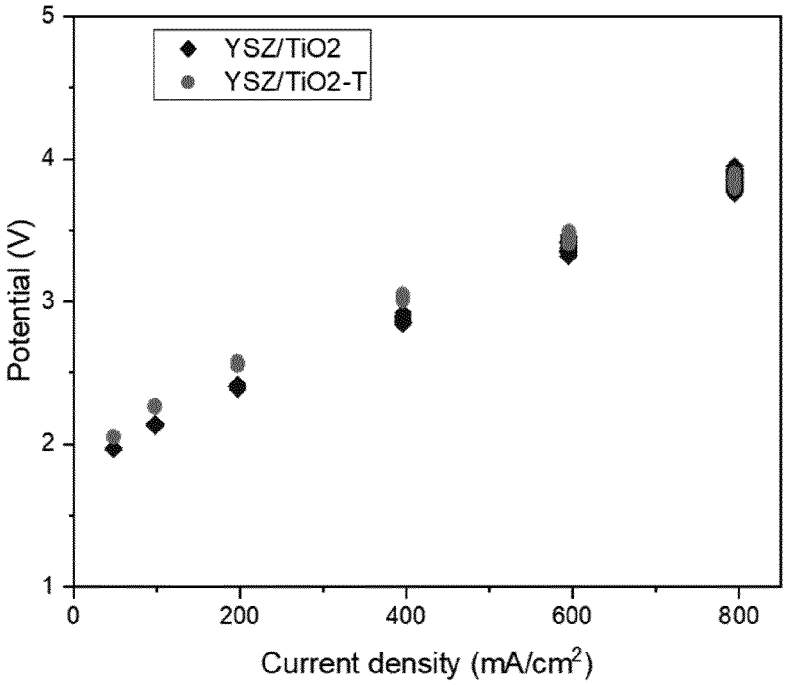
FIG. 5 Preliminary alkaline water electrolysis test using the prepared porous ceramic membrane (YSZ-$TiO_2$) and the $TiO_2$-coated porous ceramic membrane (YSZ-$TiO_2$-T) (700 μm)

In a subsequent step the green body is sintered to compact and solidify the metal oxide and $TiO_2$ nanoparticles, with at least partial removal of the polymer resin, thus obtaining the porous ceramic support layer (See example 3). Although the thus obtained material has a surprisingly narrow pore size distribution (See FIG. 3), the average pore size of such materials does not enable an application in electrochemical cells, therefore a coating of $TiO_2$ nanoparticles is being applied (See Example 4). In an embodiment said coating comprises a first step exposing the base porous ceramic membrane to a composition comprising $TiO_2$ nanoparticles and a binder. In a second step the thus coated porous ceramic support layer is dried and sintered to remove the binder and solidify the layer of $TiO_2$ nanoparticles onto the porous ceramic support layer, thus obtaining the $TiO_2$-coated porous ceramic support layer (See Example 4 and herein referred to as YSZ-$TiO_2$-T). Where such coating further reduced the average pore size, as evident from the increased area resistance (See Table 4), it hardly affected the ionic conductivity, a key parameter in electrochemical applications as can be seen in FIG. 5. Besides lowering the permeability without affecting the other electrochemical properties such as conductivity and stability, it has also been observed that the $TiO_2$-coating layer also acts as a barrier to better hold the polymer, and in particular the ionomer, after the further densification of the pores (infra). This inevitable results in a long-term stable performance of the membranes in electrochemical applications.

The further densification of the pores is done using a polymer. Per reference to the examples below, this can be done using suitable techniques such as impregnation or an in situ polymerization reaction.

In a particular embodiment the densification of the coated ceramic membranes (YSZ-$TiO_2$-T) with ionomer is done via ionomer impregnation (Example 5) or via an in situ polymerization of the pore walls, said method comprising (i) Grafting of the walls with a surface linker, (ii) grafting of the initiator molecule onto the surface linker and (iii) performing the SI-ATRP polymerization using various monomers to form the desired polymeric layer. In situ polymerization of the pore walls could for example include the preparation of an alkaline stable monomer, i.e. 1-(4-ethenylphenyl)-2-phenyl-1H-benzimidazole, grafting the coated ceramic membranes (YSZ-$TiO_2$-T) with the surface linker aminopropyl phosphonic acid, grafting the initiator molecule α-bromoisobutyryl bromide onto the surface linker, and polymerization with the alkaline stable monomer.

Figure 6:
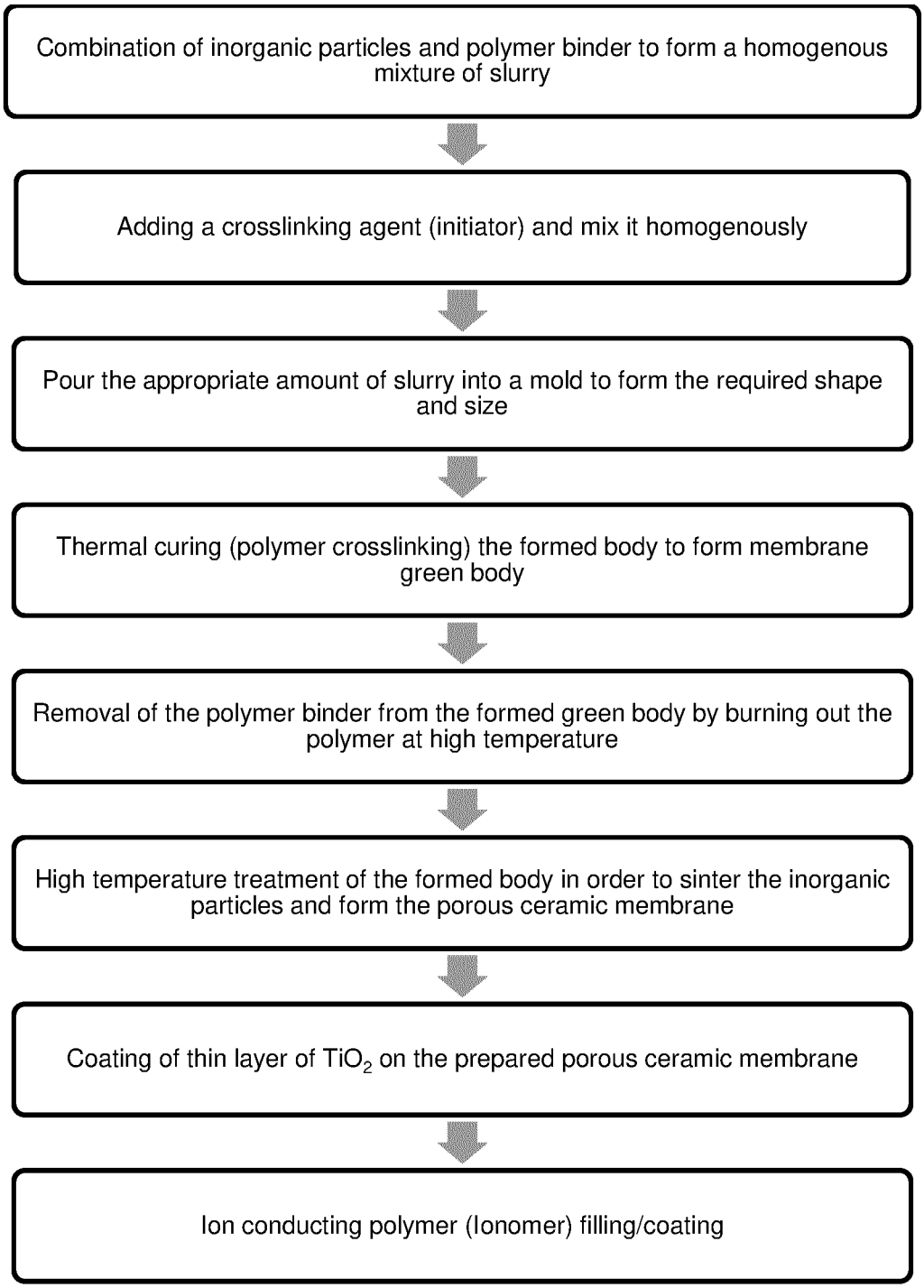
FIG. 6 shows a flow diagram of the dense composite polymeric-ceramic membrane preparation processes according to the present invention.

The overall process is schematically summarized in FIG. 6.

Numbered Embodiments of the Invention

1. A dense composite polymeric-ceramic material comprising:
   - a ceramic porous support layer composed of $TiO_2$ nanoparticles, and at least another metal oxide nanoparticle,
   - a porous coating layer of $TiO_2$ nanoparticles coated onto said ceramic porous support layer, and
   - a polymer filling pores of both porous ceramic support and coating layers.
2. The dense composite polymeric-ceramic membrane of embodiment 1, wherein the at least another metal oxide nanoparticle is selected from alumina ($Al_2O_3$), yttria fully stabilized zirconia ($Y_2O_3$-doped $ZrO_2$ (YSZ)), yttria (tetragonal zirconia polycrystal ($Y_2O_3$-doped $ZrO_2$ (Y-TZP)), $CeO_2$, $CeO_2$ tetragonal $ZrO_2$ polycrystal (Ce-TZP), $ZrO_2$, $SiO_2$, $SnO_2$, and the like; in particular the at least another metal oxide nanoparticle metal oxide nanoparticles is yttrium-doped zirconium oxide (YSZ).

3. The dense composite polymeric-ceramic material of embodiments 1 or 2, further comprising a polymer resin; in particular a cross-linkable polymer.

4. The dense composite polymeric-ceramic material of embodiment 3, wherein the polymer resin is selected from an acrylate that can be cross-linked using a thermal initiator (e.g. a cross-linking agent) or an acrylate that may be cross-linked using an ultraviolet (UV) light-activated initiator, for example but not limited to, polyethylene glycol diacrylate (PEGDA) plus a thermal initiator (e.g., 3 wt % Luperox 331).

5. The dense composite polymeric-ceramic material according to any one of the preceding embodiments, wherein the ceramic porous support material comprises $TiO_2$ nanoparticles in a range of about 1 wt % to about 20 wt % of the total dense composite polymeric-ceramic material; in particular in a range of about 5 wt % to about 15 wt % of the total dense composite polymeric-ceramic material.

6. The dense composite polymeric-ceramic material according to any one of the preceding embodiments, wherein the ceramic porous support material comprises the at least another metal oxide nanoparticles in a range of about 50 wt % to about 80 wt % of the total ceramic porous support material; in particular in a range of about 60 wt % to about 70 wt % of the total ceramic porous support material.

7. The dense composite polymeric-ceramic material according to any one of the preceding embodiments, wherein the ceramic porous support has an average pore size in the range of about 80 to 200 nm.

8. The dense composite polymeric-ceramic material according to any one of the preceding embodiments, wherein said ceramic porous support material is a membrane with a thickness between about 50 and 2000 μm; in particular between 50 and 1000 μm; more in particular between 50 and 200 μm.

9. The dense composite polymeric-ceramic material according to any one of the preceding embodiments, wherein the coating layer of TiO2 nanoparticles has an average thickness between 0.5 and 5 μm and average pore size distribution between 50 and 150 nm.

10. The dense composite polymeric-ceramic material according to any one of embodiments 1 to 9 wherein the polymer filling in the pores of the ceramic porous support material is done via polymer impregnation.

11. The dense composite polymeric-ceramic material according to embodiment 10, wherein the polymer is selected from any suitable polymer, such as polysulfone (PSU) and polypropylene oxide (PPO), an anion-binding polymer, an ionomer or combinations thereof 12. The dense composite polymeric-ceramic material according to embodiment 11, wherein the ionomer is selected from a halogen ionomer, such as a fluorinated ionomer containing sulfonate groups based on ionized sulfonic acid (e.g., fluorosulfonic acid (i.e., FSA) ionomer), or a hydrocarbon ionomer preferably containing (meth)acrylate groups based on ionized (meth)acrylic acid; or combinations thereof.

13. The dense composite polymeric-ceramic material according to any one of embodiments 1 to 9 wherein the polymer filling the pores of the ceramic porous support material is done via in situ polymerization of the pore walls.

14. The dense composite polymeric-ceramic material according to embodiment 12, wherein the in situ polymerization consists of a surface-initiated, atom-transfer radical polymerization (SI-ATRP) reaction; in particular using a monomer such as (but not limited to) acrylate and styrene derivatives.

15. Method of manufacturing a dense composite polymeric-ceramic material as defined in any one of embodiments 1 to 13, comprising:

combining $TiO_2$ nanoparticles, at least another metal oxide nanoparticle and a curable polymer resin to create a mixture;

curing the mixture to obtain a first composite material;

heating the first composite material to a first temperature for removing the polymer from said first composite material to obtain a second composite material;

heating the second composite material to a second temperature for sintering the $TiO_2$ nanoparticles, and the at least another metal oxide nanoparticles, thereby creating the ceramic porous support layer;

coating said ceramic porous support layer with a $TiO_2$ suspension to obtain a $TiO_2$-coated ceramic porous support layer; and polymer filling pores of the $TiO_2$-coated ceramic porous support layer to obtain the dense composite polymeric-ceramic material as defined in any one of embodiments 1 to 14.

16. The method of embodiment 15, wherein the at least another metal oxide nanoparticle is selected from alumina ($Al_2O_3$), yttria fully stabilized zirconia ($Y_2O_3$-doped $ZrO_2$ (YSZ)), yttria (tetragonal zirconia polycrystal ($Y_2O_3$-doped $ZrO_2$ (Y-TZP)), $CeO_2$, $CeO_2$ tetragonal $ZrO_2$ polycrystal (Ce-TZP), $ZrO_2$, $SiO_2$, $SnO_2$, and the like; in particular the at least another metal oxide nanoparticle metal oxide nanoparticles is yttrium-doped zirconium oxide (YSZ).

17. The method of embodiment 15, wherein the polymer resin is selected from an acrylate that can be cross-linked using a thermal initiator (e.g. a cross-linking agent) or an acrylate that may be cross-linked using an ultraviolet (UV) light-activated initiator, for example but not limited to, polyethylene glycol diacrylate (PEGDA) plus a thermal initiator (e.g., 3 wt % Luperox 331).

18. The method of embodiment 15, wherein the mixture comprises $TiO_2$ nanoparticles in a range of about 1 wt % to about 20 wt % of the total mixture of $TiO_2$ nanoparticles, at least another metal oxide nanoparticle and a curable polymer resin; in particular in a range of about 5 wt % to about 15 wt % of the total mixture.

19. The method of embodiment 15, wherein the mixture comprises at least another metal oxide nanoparticle in a range of about 50 wt % to about 80 wt % of the total mixture of $TiO_2$ nanoparticles, at least another metal oxide nanoparticle and a curable polymer resin; in particular in a range of about 60 wt % to about 70 wt % of the total mixture.

20. The method of embodiment 15, wherein the $TiO_2$ suspension comprises $TiO_2$ in a range of about 1 wt % to about 5 wt %.

21. The method of embodiment 15, wherein the porous ceramic support material is coated with $TiO_2$ via dip-coating.

22. The method of any one of embodiments 15 to 21, wherein the $TiO_2$-coated porous ceramic support material is further functionalized with a pore filling layer of polymer brushes formed via in situ polymerization of the pore walls 23. The method of embodiment 22, wherein the in situ polymerization consists of a surface-initiated atom-transfer radical polymerization (SI-ATRP) reaction; in particular using a monomer such as (but not limited to) acrylate and styrene derivatives.

24. The method of any one of embodiments 15 to 21, wherein the pores of the $TiO_2$-coated porous ceramic support material are filled with a polymer via polymer impregnation.

25. The method of embodiment 24, wherein the polymer is selected from any suitable polymer, such as polysulfone (PSU) and polypropylene oxide (PPO), an anion-binding polymer, an ionomer or combinations thereof 26. The method of embodiment 25, wherein the ionomer is selected from a halogen ionomer, such as a fluorinated ionomer containing sulfonate groups based on ionized sulfonic acid (e.g., fluorosulfonic acid (i.e., FSA) ionomer), or a hydrocarbon ionomer preferably containing (meth)acrylate groups based on ionized (meth)acrylic acid; or combinations thereof.

27. The method of any one of embodiments 24 to 26, wherein:

the pores from one side of the $TiO_2$-coated ceramic porous support layer are filled with a first ionomer via diffusion of a solution of said ionomer from that side followed by precipitation of said ionomer, and the pores from the other side of the $TiO_2$-coated ceramic porous support layer are filled with a second ionomer via diffusion of a solution of said ionomer from that second side followed by precipitation of said ionomer.

28. Use of the dense composite polymeric-ceramic material according to any one of embodiments 1 to 14, or obtained according to the methods of any one of embodiments 15 to 27 in filtration or electrochemical applications, such as a fuel-cell, hydrogen peroxide production and alkaline water electrolysis.

Examples

Example 1. Preparation of Inorganic Particles-Polymer Slurry

In a thinky mixer (ARE-250 CE) slurry container, 5.4 g Poly(ethylene glycol) diacrylate (PEGDA, 27 wt. %, Sigma-Aldrich, average $M_n$ 575) was added, followed by 6 g of YSZ (TOSOH EUROPE B.V.). This was mixed for 2 mins at 2000 rpm. The remaining YSZ (6 g) was added and mixed for 2 mins at 2000 rpm. Similarly, 10 wt. % $TiO_2$ nanoparticles (2 g) was added and mixed for 2 mins at 2000 rpm. The slurry container was cooled down to room temperature before the next step. Finally, 3 wt. % L331 initiator (Arkema) with respect to the total mixture (0.67 mL) was added and mixed for 2 mins at 2000 rpm, followed by defoaming step, mixing at 900 rpm for 1 min. In parallel, slurry without $TiO_2$ nanoparticles, in which 70 wt. % of YSZ used was prepared for comparison of YSZ-based membrane properties with and without $TiO_2$.

Example 2. Preparation of Membrane Green Body

Teflon mold (500 μm) with different dimensions (e.g., 3 cm, 5 cm diameters and 5.3×3.3 $cm^2$ rectangular) were prepared and placed on top of a glass support. The homogenous slurry was filled in a syringe container and pressed and poured into the Teflon mold placed on top of a glass support. The slurry was then pressed and uniformly distributed to fill the chamber using a second glass cover. Four clamps were used to clamped at the ends of the glass cover and support. The sample was then shaken for 2 h at 85 per minute using lab shake. It was then thermally cured at 100° C. during overnight in an oven. A self-standing polymer/nanoparticles material (known as membrane green body) was collected from the mold.

Example 3. Preparation of Porous Ceramic Membrane

Briefly, the polymer template was removed from the membrane green body by heating the sample at 180° C. for 2 h, 250° C. for 4 h and 400° C. for 2 h in a box furnace under air. Heating rate of 60° C./h was used. Subsequently, the ceramic nanoparticles were heated from 400° C. to 800° C. at a heating rate of 120° C./h and held for a dwell time of 4 h. The temperature was then increased to 1100° C. for 15 h and decreased to 80° C. at a heating and cooling rate of 120° C./h. The porous ceramic membranes, prepared in this way, with and without $TiO_2$ nanoparticles are named YSZ-$TiO_2$ and YSZ, respectively. Table 1 presents the composition of the porous ceramic membranes.

Composition of the Prepared Porous Ceramic Membranes

TABLE 1

| Membrane composition (nanoparticles, polymer binder and initiator) | | | | |
|---|---|---|---|---|
| Membrane | YSZ (wt. %) | $TiO_2$ (wt. %) | PEGDA (wt. %) | L331 (wt. %) |
| YSZ | 70 | 0 | 27 | 3 |
| YSZ-$TiO_2$ | 60 | 10 | 27 | 3 |

*wt. % is calculated considering the total weight of the slurry.

Example 4. Preparation of $TiO_2$ Suspension and Coating of the YSZ-$TiO_2$ Membranes to Yield the YSZ-$TiO_2$-T Membranes Commercially available $TiO_2$ powders (~100 nm in size, anatase phase, 99.9%, US Research Nanomaterials, Inc, America) and Poly(vinyl alcohol) (PVA 72000, Fluka Chemica) were employed as the starting powders and binder, respectively, to make the $TiO_2$ suspension. The determined amount of $TiO_2$ powder particles was dispersed into DI water and ultrasonicated for 15 min. Table 2 presents the composition of the prepared $TiO_2$ suspension. The obtained suspension was then stirred for 2 h. Following that, 1 wt. % PVA was added into the suspension as a binder. The suspension was then continuously stirred for 24 h before being degassed in vacuum ambiance to remove air bubbles.

TABLE 2

| Composition of the prepared $TiO_2$ suspension. | | |
|---|---|---|
| $TiO_2$ (wt. %) | PVA (wt. %) | DI water (wt. %) |
| 3 | 1 | 96 |

Dip-coating (RDS15 Dip Coater machine) with a 30 s dipping time and a 5 mm/s withdrawal speed was used to coat the prepared $TiO_2$ suspension on the surface of the prepared ceramic membrane. The modified membranes were then dried at room temperature for 48 h. After that, the membranes were heated to 500° C. for 3 h to remove the PVA binder, then continuously heated to 800° C. for 4 hours under air to achieve sintering temperature. The heating and cooling rates were each set to 1° C./min.

Example 5. Membrane Densification via Ionomer Impregnation, Yielding the YSZ-$TiO_2$-T Ionomer Membranes The impregnation of commercial ionomer into the pristine or modified porous ceramic membrane is done as follows: The AP2-HNN8-00-X (Aemion+™, high ion exchange capacity anion exchange polymer dry resin) is dissolved in NMP or Methanol (5 to 20 wt./v %). The ceramic membranes are immersed in the prepared solution for 24 h. The membranes were taken out and surface-cleaned using tissue paper wetted with NMP or Methanol to remove the surface polymer resins. The membranes were then immersed in DI water for 24 h. The membranes were then dried at 50° C. oven for 24 h before further characterizations.

Example 6: Membrane Characterizations

The following characterizations were performed on both the modified and the unmodified membranes.

The prepared porous ceramic membranes were characterized in terms of thickness, diameter before and after sintering. The final porous ceramic membranes were characterized in term of ionic conductivity, density, porosity, pore size, thermal stability.

The performance of the prepared porous ceramic membranes were also tested in alkaline water electrolysis using the following conditions.

| Parameter | Value/type |
|---|---|
| Catholyte | 1M KOH |
| Anolyte | 1M KOH |
| Current collector | Optimized plate |
| Temperature | 25, 40 and 60° C. |
| Scan rate | 10 mV/s |
| Cell pressure | 4 bar |
| Flow | 200 ml/min |

Figure 2:
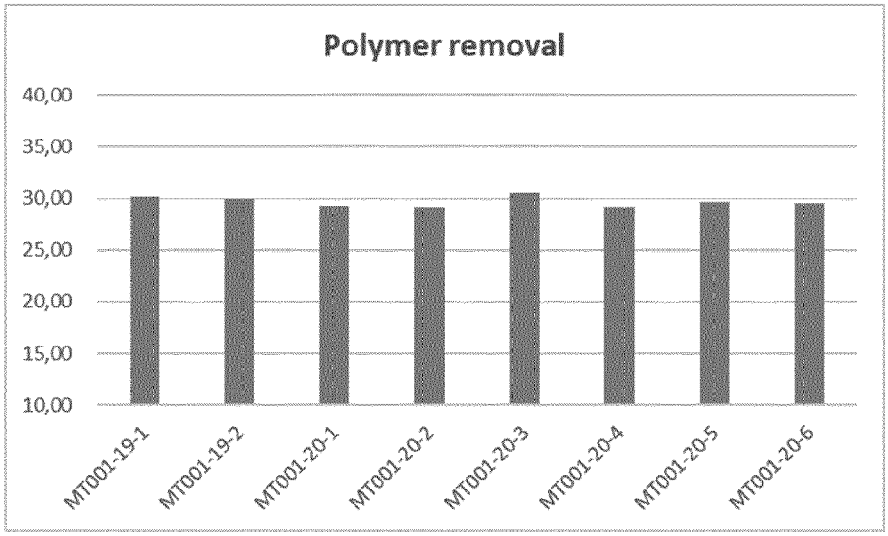
FIG. 2 percent of polymer removal after membrane sintering of the membrane according to the present invention.

FIG. 2 shows the polymer weight percent removal of different batches of the membranes after sintering. For this, the weights of the membranes before and after sintering were recorded. The decrease indicates the amount and successful removal of polymer from the material, shown to be consistent amongst the different batches.

TABLE 3

Physical properties (pore size, pore size distribution and porosity) of the prepared membrane determined via Hg porosimetry measurement. The bulk and apparent densities of the membranes were determined via He pycnometer.

| | Unit | YSZ-$TiO_2$ | YSZ-$TiO_2$-T |
|---|---|---|---|
| Total pore area | $m^2/g$ | 3.9 | 3.6 |
| Total cumulative volume | $mm^3/g$ | 244 | 239 |
| Average pore size | nm | 172 | 169 |
| Bulk density | $g/cm^3$ | 2.6 | 2.5 |
| Apparent density | $g/cm^3$ | 7.1 | 6.0 |
| Porosity | % | 63 | 59 |
| Thickness | μm | 600-700 | 600-700 |

Figure 3:
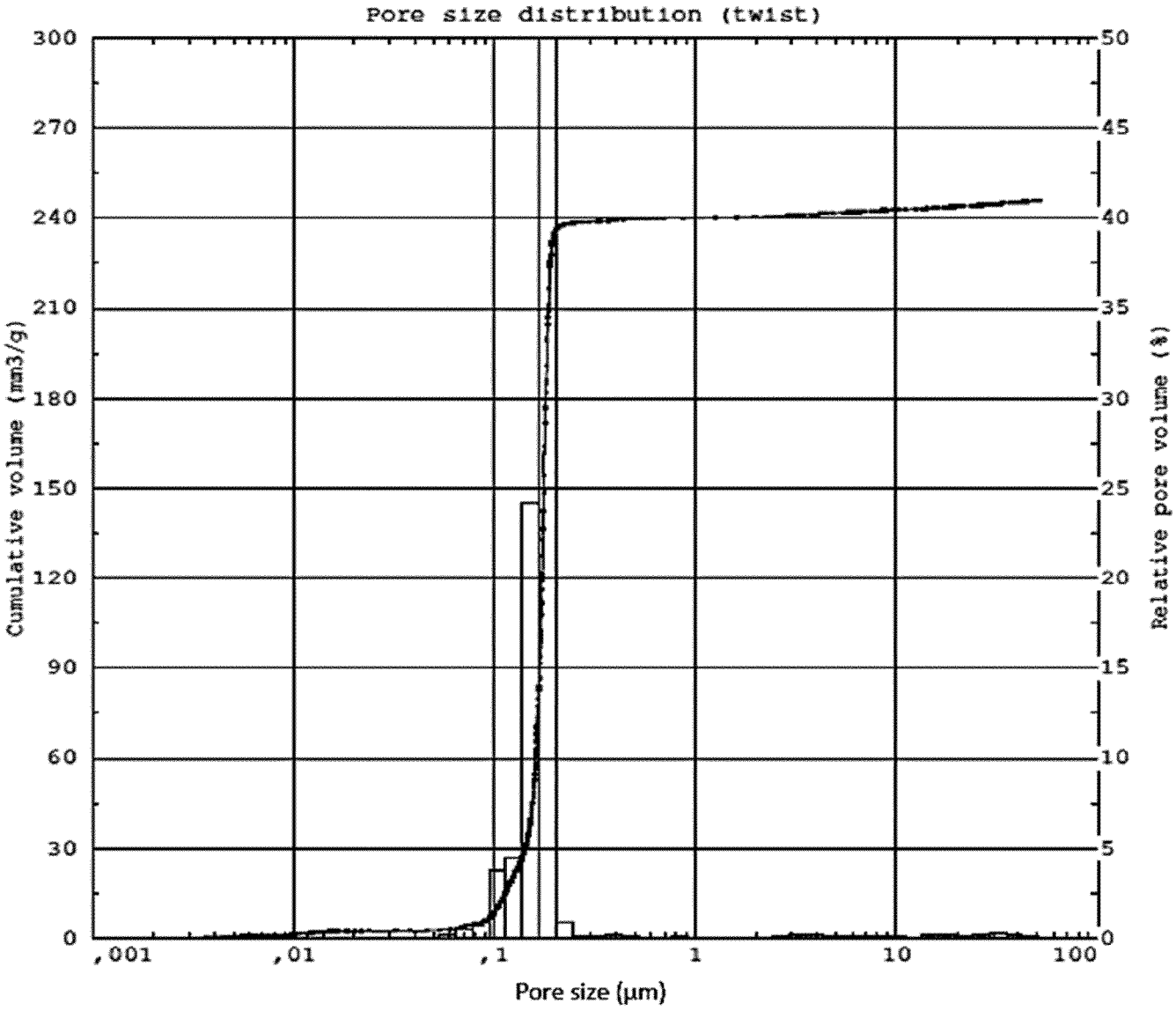
FIG. 3 shows the pore size distribution of the ceramic porous support layer used in the manufacture of the dense composite polymeric-ceramic membranes according to the present invention.

FIG. 3 shows the pore size distribution of YSZ-$TiO_2$ membrane. The YSZ-$TiO_2$ membrane exhibits a surprisingly narrow pore size distribution with an average pore size of 172 nm. Values range of about 90 nm to about 200 nm. The cumulative pore volume is up to about 240 $mm^3/g$.

TABLE 4

Ionic conductivity of YSZ-$TiO_2$, YSZ-$TiO_2$-T and YSZ-TiO2-T-ionomer membranes

| Membrane | Area resistance ($\Omega \cdot cm^2$) | Ionic conductivity (mS/cm) at 6M KOH, 30° C. |
|---|---|---|
| YSZ-$TiO_2$ | 0.175 ± 0.013 | 368 ± 25 |
| YSZ-TiO2-T | 0.207 ± 0.055 | 361 ± 19 |
| YSZ-TiO2-T-ionomer | 0.36 ± 0.05 | 216 ± 12 |

Ionic conductivity of 6M KOH at 30° C. is 688 mS/cm.

Alkaline Stability of Prepared Membranes in 6 M KOH at 60° C. for 14 Days

| Membrane | Wt.(%) loss | Ionic conductivity loss |
|---|---|---|
| YSZ-$TiO_2$ | ND | ND |
| YSZ-TiO2-T | ND | ND |
| YSZ-TiO2-T-ionomer | ND | ND |

ND: Not detected. Membranes are stable under these conditions

Gas Permeability Through YSZ-$TiO_2$, YSZ-$TiO_2$.T and YSZ-$TiO_2$-T-Ionomer Membranes

| Membrane | Gas Flux (L/min · cm2) at 5 bar |
|---|---|
| YSZ-$TiO_2$ | 4.28 + 0.87 |
| YSZ-TiO2-T | 3.95 + 0.38 |
| YSZ-TiO2-T-ionomer | 2.20 + 0.24 |

Figure 4:
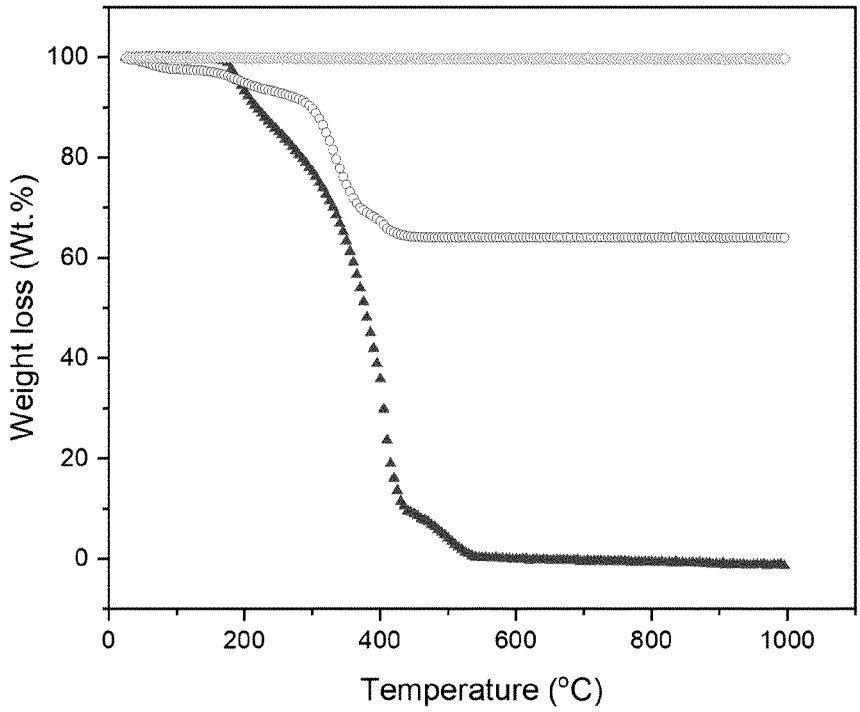
FIG. 4 shows the thermal stability of the ceramic porous support material according to the present invention.

FIG. 4 shows the Thermogravimetric analysis (TGA) of the PEGDA (Lower line), cured (Middle line) and sintered (Upper line) of the YSZ-$TiO_2$ membrane. The sintered material is stable within the tested temperature range.

FIG. 5 presents preliminary alkaline water electrolysis employing the membranes according to the invention and showing the consistent correlation between Potential (V) and current Density for the porous ceramic membrane (YSZ-$TiO_2$), and the $TiO_2$-coated porous ceramic membrane (YSZ-$TiO_2$-T).

The invention claimed is:

1. A dense composite polymeric-ceramic material consisting of:

a sintered ceramic porous support layer composed of $TiO_2$ nanoparticles, and at least another metal oxide nanoparticle, wherein the $TiO_2$ nanoparticles, and the at least another metal oxide nanoparticle are bonded to each other, wherein the at least another metal oxide nanoparticle is selected from alumina ($Al_2O_3$), yttria stabilized zirconia (YSZ), yttria tetragonal zirconia polycrystal (Y-TZP), $CeO_2$, $CeO_2$ tetragonal $ZrO_2$ polycrystal (Ce-TZP), $ZrO_2$, $SiO_2$, and $SnO_2$, a porous coating layer of $TiO_2$ nanoparticles coated onto the ceramic porous support layer, and a polymer filling the pores of both the ceramic porous support layer and the porous coating layer of $TiO_2$ nanoparticles, wherein the polymer is selected from polysulfone (PSU), polypropylene oxide (PPO), an ion-exchange polymer, an ionomer, and combinations thereof.

2. The dense composite polymeric-ceramic material according to claim 1, wherein the ceramic porous support layer comprises an amount of the $TiO_2$ nanoparticles in a range of about 1 wt % to about 20 wt % based on a total weight of the ceramic porous support layer.

3. The dense composite polymeric-ceramic material according to claim 2, wherein the ceramic porous support layer comprises $TiO_2$ nanoparticles in a range of 5 wt % to 15 wt % of the ceramic porous support layer.

4. The dense composite polymeric-ceramic material according to claim 1, wherein the ceramic porous support layer comprises an amount of the at least another metal oxide nanoparticles in a range of about 50 wt % to about 80 wt % based on a total weight of the ceramic porous support layer.

5. The dense composite polymeric-ceramic material according to claim 4, wherein the ceramic porous support layer comprises the at least another metal oxide nanoparticles in a range of 60 wt % to 70 wt % of the ceramic porous support layer.

6. The dense composite polymeric-ceramic material according to claim 1, wherein the ceramic porous support layer has an average pore size in a range of about 80 nm to 200 nm.

7. The dense composite polymeric-ceramic material according to claim 1, wherein the dense composite polymeric-ceramic material is a membrane with a thickness between about 50 μm and 2000 μm.

8. The dense composite polymeric-ceramic material according to claim 7, wherein the dense composite polymeric-ceramic material is a membrane with a thickness between 50 μm and 200 μm.

9. The dense composite polymeric-ceramic material according to claim 1, wherein the porous coating layer of $TiO_2$ nanoparticles has an average thickness between 0.5 mm and 5 mm, and pores with an average pore size distribution between 50 nm and 150 nm.

10. The dense composite polymeric-ceramic material according to claim 1, wherein the polymer filling the pores is carried out via polymer impregnation.

11. The dense composite polymeric-ceramic material according to claim 1, wherein the ionomer is selected from a halogen ionomer, an anion-containing ionomer, a hydrocarbon ionomer, and combinations thereof.

12. A fuel-cell comprising the dense composite polymeric-ceramic material according to claim 1.

13. A method of manufacturing the dense composite polymeric-ceramic material according to claim 1, comprising:

combining $TiO_2$ nanoparticles, at least another metal oxide nanoparticle, and a curable polymer resin to create a mixture, wherein the at least another metal oxide nanoparticle is selected from alumina ($Al_2O_3$), yttria stabilized zirconia (YSZ), yttria tetragonal zirconia polycrystal (Y-TZP), $CeO_2$, $CeO_2$ tetragonal $ZrO_2$ polycrystal (Ce-TZP), $ZrO_2$, $SiO_2$, and $SnO_2$;

curing the mixture to obtain a first composite material;

heating the first composite material to a first temperature for removing the polymer from said first composite material to obtain a second composite material;

heating the second composite material to a second temperature for sintering the $TiO_2$ nanoparticles, and the at least another metal oxide nanoparticle, thereby creating the ceramic porous support layer wherein the $TiO_2$ nanoparticles, and the at least another metal oxide nanoparticle are bonded to each other;

coating the ceramic porous support layer with a $TiO_2$ suspension to obtain a $TiO_2$-coated ceramic porous support layer; and filling the pores of the $TiO_2$-coated ceramic porous support layer with a polymer selected from polysulfone (PSU), polypropylene oxide (PPO), an ion-exchange polymer, an ionomer, and combinations thereof.

14. The method of claim 13, wherein the curable polymer resin comprises is selected from an acrylate that is cross-linked using a thermal initiator or an ultraviolet (UV) light-activated initiator.

15. The method of claim 13, wherein the ceramic porous support layer comprises an amount of the $TiO_2$ nanoparticles in a range of about 1 wt % to about 20 wt % based on a total weight of the ceramic porous support layer.

16. The method of claim 13, wherein the ceramic porous support layer comprises an amount of the at least another metal oxide nanoparticles in a range of about 50 wt % to about 80 wt % based on a total weight of the ceramic porous support layer.

17. The method of claim 13, wherein the $TiO_2$ suspension comprises an amount of the $TiO_2$ in a range of about 1 wt % to about 5 wt %.

18. The method of claim 13, wherein:

the pores from a first side of the $TiO_2$-coated ceramic porous support layer are filled with a first ionomer via diffusion of a solution of the first ionomer followed by precipitation of the first ionomer, and the pores from a second side of the $TiO_2$-coated ceramic porous support layer are filled with a second ionomer via diffusion of a solution of the second ionomer followed by precipitation of the second ionomer.

19. The method of claim 13, wherein the at least another metal oxide nanoparticle comprises yttrium-doped zirconium oxide ($Y_2O_3$-doped $ZrO_2$).

20. The method of claim 13, wherein the ceramic porous support layer comprises an amount of the $TiO_2$ nanoparticles in a range of 5 wt % to 15 wt % based on a total weight of the ceramic porous support layer.

21. The method of claim 13, wherein the ceramic porous support layer comprises an amount of the at least another metal oxide nanoparticles in a range of 60 wt % to 70 wt % based on a total weight of the ceramic porous support layer.

* * * * *